US006579157B1

(12) United States Patent
Gotkis et al.

(10) Patent No.: US 6,579,157 B1
(45) Date of Patent: Jun. 17, 2003

(54) POLISHING PAD IRONING SYSTEM AND METHOD FOR IMPLEMENTING THE SAME

(75) Inventors: Yehiel Gotkis, Fremont, CA (US); Aleksander A. Owczarz, San Jose, CA (US); Rodney Kistler, Los Gatos, CA (US)

(73) Assignee: Lam Research Corporation, Fremont, CA (US)

( * ) Notice: Subject to any disclaimer, the term of this patent is extended or adjusted under 35 U.S.C. 154(b) by 109 days.

(21) Appl. No.: 09/823,788

(22) Filed: Mar. 30, 2001

(51) Int. Cl.[7] ..... B24B 1/00

(52) U.S. Cl. ..... 451/56; 451/41; 451/72; 451/286; 451/443

(58) Field of Search ..... 541/36, 41, 56, 541/60, 72, 286, 306, 443, 444, 446

(56) References Cited

U.S. PATENT DOCUMENTS 5,216,843 A * 6/1993 Breivogel et al. ..... 451/285
5,810,964 A * 9/1998 Shiraishi ..... 156/345.12
6,162,112 A * 12/2000 Miyazaki et al. ..... 451/36
6,340,326 B1 * 1/2002 Kistler et al. ..... 451/286
6,361,411 B1 * 3/2002 Chopra et al. ..... 451/56

* cited by examiner

*Primary Examiner*—Joseph J. Hail, III
*Assistant Examiner*—Anthony Ojini
(74) *Attorney, Agent, or Firm*—Martine & Penilla, LLP

(57) ABSTRACT

A method for smoothing a surface of a polishing pad previously used in planarizing a surface of a substrate in a chemical mechanical planarization (CMP) system is provided. The method starts by conditioning the surface of the polishing pad so as to create a post-conditioned surface having a plurality of asperities. The post-conditioned surface of the polishing pad is then ironed, thus compressing the plurality of asperities onto the post-conditioned surface of the polishing pad such that the plurality of asperities lay substantially flat against the post-conditioned surface of the polishing pad.

10 Claims, 13 Drawing Sheets

POLISHING PAD IRONING SYSTEM AND METHOD FOR IMPLEMENTING THE SAME

BACKGROUND OF THE INVENTION

1. Field of the Invention

The present invention relates generally to chemical mechanical planarization (CMP) systems and techniques for improving the performance and effectiveness of CMP operations. Specifically, the present invention relates to CMP systems that implement polishing pads with improved post-conditioned surfaces.

2. Description of the Related Art

In the fabrication of semiconductor devices, there is a need to perform CMP operations, including topography planarization, polishing, buffing, and post-CMP wafer cleaning. Typically, integrated circuit devices are in the form of multi-level structures. At the substrate level, transistor devices are formed. In subsequent levels, interconnect metallization lines are patterned and electrically connected to the transistors to define the desired functional devices. As is well known, patterned conductive layers are insulated from other conductive layers by dielectric materials, such as silicon dioxide. At each metallization level and/or associated dielectric layer, there is a need to shape the metal interconnects and/or planarize the dielectric material. Without planarization, fabrication of additional metallization layers becomes substantially more difficult due to the higher variations in the surface topography. In other applications, metallization line patterns are formed in the dielectric material, and then metal CMP operations are performed to remove the overburden metallization.

CMP systems typically implement rotary, belt, or orbital material removal approaches, brush stations, and spin/rinse dryers in which belts, pads, or brushes are used to polish, buff, scrub, rinse, and dry one or both sides of a wafer. Slurry is used to assist the CMP operation. Slurry is most usually introduced onto a moving preparation surface, e.g., belt, pad, and the like, and distributed over the preparation surface as well as the surface of the semiconductor wafer being buffed, polished, or otherwise prepared by the CMP process. The distribution is generally accomplished by a combination of the motion of the preparation surface, the motion of the semiconductor wafer and the pressure created between the semiconductor wafer and the preparation surface.

An exemplary prior art CMP system 100 is illustrated in FIG. 1. The CMP system 100 is a belt-type system, so designated because the preparation surface is an endless polishing pad 108 mounted on two drums 114 which drive the polishing pad 108 in a rotational motion as indicated by polishing pad rotation directional arrows 116. A wafer 102 is mounted on a carrier 104, which rotates in a direction 106. The rotating wafer 102 is then applied against the rotating polishing pad 108 with a force F. Some CMP processes require a significant force F to be applied. A platen 112 is provided to stabilize the polishing pad 108 and to provide a surface onto which to apply the wafer 102. Typically, the platen 112 applies air to a gap between a top side of the platen 112 and the underside of the pad 108. Slurry 118, typically including an aqueous solution containing dispersed abrasive particles (e.g., $SiO_2$, $Al_2O_3$, $CeO_2$, etc.) is introduced upstream of the wafer 102.

Normally, the polishing pad 108 is composed of porous or fibrous materials. However, over a period of polishing, a residue consisting of abrasive particles of the slurry 118 and the by-products removed from the surface of the wafer 102 accumulates over the surface of the polishing pad 108, thus affecting the polishing rate and planarization efficiency. As a result, to maintain a stable material removal rate and high planarization efficiency, there is a need to condition the surface of the polishing pad 108.

As illustrated in FIG. 1, the polishing pad 108 is conditioned by applying a conditioning disk 122 onto the surface of the polishing pad 108. The conditioning disk 122 is mounted on a conditioning head 124 and moves along a track bar 123 across the polishing pad 108. Typically, the conditioning disk 122 includes a plurality of diamonds (not shown in this Figure) which are applied onto the surface of the polishing pad 108, thus removing the residue clogging the porous surface of the polishing pad 108. In addition to unclogging the pores, the conditioning disk 122 further removes the worn surface of the polishing pad 108, thus exposing a fresh layer of pad material. However, while pad conditioning positively effects the CMP process, it also affects the surface roughness of the polishing pad 108 thus degrading the planarization efficiency of the polishing pad 108.

The effects of conditioning on the polishing pad 108 can further be understood with reference to the enlarged, partial, cross-sectional view of the post-conditioned polishing pad 108 depicted in prior art FIG. 2A. As illustrated, a plurality of air pockets 108*d* are disbursed through out the surface of the polishing pad 108. Initially, a surface 108*c* of an unused polishing pad 108 is covered with air pockets 108*d*, which in a conditioning operation, are ripped open creating pores 108*b* and pad roughness features herein defined as asperities 108*a*. Thereafter, during the CMP operation, the slurry 118 is introduced onto the surface of the surface 108*c* of the polishing pad 108 such that the pores 108*b* and asperities 108*a* are covered with slurry 118. As shown, asperities 108*a* have different sizes and shapes.

Prior art FIG. 2B is an illustration of asperities 108*a*-1, 108*a*-2, and 108*a*-3, each having a different shape and size. As shown, the conditioning and roughening of the surface 108*c* of the polishing pad 108 creates the asperities 108*a*-1, 108*a*-2, and 108*a*-3 some of which significantly protrude above the surface 108*c* (e.g., asperity 108*a*-1). As discussed below with respect to FIGS. 3A–3C and 4A–4E, the formation of the asperities 108*a*, and specifically, the asperities that significantly protrude above the surface 108*c* are problematic during the CMP operation, as among others, the asperities 108*a* intrude into the depths of the features, thus degrading planarization uniformity.

The prior art FIG. 3A depicts an enlarged, partial, cross-sectional view of an ideal post-CMP oxide layer 250 having a heterogeneous top surface 250*a*. As shown, a plurality of copper metallization lines 254, 256, and 258 and a conductive via 251 have been fabricated in the oxide layer 250 implementing a dual damascene process. As is well known, in a dual damascene process, there is a need to perform a CMP operation so as to planarize and remove the overburden copper material from over the heterogeneous top surface 250*a*.

As shown, the copper metallization line 254 has two boundary sidewalls 255*a* and 255*b*. Ideally, sharp corners 254*a* and 254*b* should respectively be created at the intersection of boundary side-walls 255*a* and 255*b* with the corresponding oxide regions 250*d* and 250*c* of the heterogeneous top surface 250*a*. In a like manner, each of the copper metallization lines 256 and 258 has respective boundary side-walls 257*a*, 257*b*, and 259*a* with oxide regions 250*c* and 250*b*, respectively. Again, in theory, sharp corners 256*a*, 256*b*, and 258*a* should correspondingly be created at the intersection of each of the boundary sidewalls 257*a*, 257*b*, and 259*a* with the respective oxide regions 250*c* and 250*b*. Additionally, in theory, subsequent to the CMP operation, a top surface 254*c*, 256*c*, and 258*c* of each of the respective copper metallization lines 254, 256, and 258 should be in the same level as the heterogeneous top surface 250*a*. That is, it is expected that the thickness of the copper metallization lines 254, 256, and 258 stay the same throughout each of the copper metallization lines. However, this is not an accurate representative of a real post-CMP oxide layer.

Normally, the top surfaces of the copper metallization lines of heterogeneous oxide surfaces may not be flat. The top surfaces of the copper metallization lines defined in the same level as the oxide regions also commonly suffer from this problem. Based on experimental testing, the top surfaces of the copper metallization lines are some times defined below the level of the heterogeneous top surface 250*a* and the thickness of the copper metallization lines vary throughout each of the copper metallization lines. This occurs due to a phenomenon called "dishing" herein described as the thickness reduction of mechanically planarized copper metallization lines as a result of the moving polishing pad contacting the surface of the copper metallization lines under pressure.

The thickness reduction of copper metallization lines as opposed to oxide regions can be explained with the well-known Preston's Equation. According to Preston's Equation, Removal Rate=$K_p$PV, where the removal rate of a material is a function of Polishing pressure (P) and Linear Velocity (V), with $K_p$ being the Preston Coefficient, a constant determined by, among others, the properties of the material being planarized and the polishing slurry used. Accordingly, when the $K_p$ of copper is significantly higher than the $K_p$ of oxide, based on the Preston's Equation, copper is polished faster than oxide, creating recessed regions in the copper metallization lines, thus exposing their sharp corners.

Additionally, as a result of dishing, the intersections of the copper metallization lines and oxide regions are rounded corners due to a phenomenon called "corner rounding." Typically, the exposure of the sharp corners caused by dishing results in the removal of the oxide adjacent to the exposed corners. Furthermore, where the oxide regions are narrow, the high selectivity of $K_p$ of copper over $K_p$ of oxide causes the narrow oxide regions to be removed at the same removal rate of copper. As a result, in narrow oxide spacings, when the extensions of corner rounding on both sides of oxide spacings overlap, the so-called "dielectric erosion" is caused.

Generally, dishing, corner rounding, and dielectric erosion occur as a result of the moving polishing pad 108 and thus the asperities 108*a* contacting the heterogeneous top surface. In fact, the key contributor of these negative effects are the asperities 108*a*, specifically, the protruding asperities 108*a*-1. For instance, the asperities 108*a* intrude into the depths of the copper metallization lines causing the recesses, thus affecting feature performance. Additionally, the asperities 108*a* are significantly larger in size than the sharp corners created at the intersections of the boundary sidewalls with the oxide regions. Consequently, the asperities 108*a*, and particularly the protruding asperities 108*a*-1, increase the removal of the adjacent oxide, aggravating the effects of corner rounding and dielectric erosion.

These phenomenon are illustrated in the enlarged, partial, cross-sectional view of a real post-CMP oxide layer 250' of prior art FIG. 3B. As shown, due to the effects of dishing and corner rounding, the thickness of the copper metallization lines 254', 256', and 258' of post-CMP oxide layer 250' varies throughout each of the copper metallization lines. For instance, as opposed to the copper metallization line 254 of FIG. 3A in which the top surface 254*c* is flat, as a result of dishing and corner rounding, a top surface of the copper metallization line 254' includes a plurality of top recessed regions 254*c*-1', 254*c*-2', and 254*c*-3'. Similarly, each of the copper metallization lines 256 and 258 has a top recessed region 256*c*' and 258*c*', respectively. Additionally, rounded corners 254*a*', 254*b*', 256*a*', 256*b*', and 258*a*' have been respectively formed at the intersections of the boundary sidewalls 255*a*', 255*b*', 257*a*', 257*b*', and 259*a*' with the oxide regions 250*d*', 250*c*', and 250*b*', respectively. Furthermore, while the wide oxide region 250*c*' has rounded corners, it has remained at about the same level as the heterogeneous top surface 250*a*' of the oxide layer 250'. However, the same thing is not true with respect to the narrow oxide region 250*b*'. In fact, the corner rounding has lead to the significant erosion of the narrow oxide region 250*b*' such that it now falls below the heterogeneous top surface 250*a'*.

The concerted effects of dishing and corner rounding on a wide copper metallization line and its adjacent wide oxide region can further be understood with respect to the prior art FIG. 3C. As shown, the thickness of the copper metallization line 254' varies throughout the copper metallization line. Specifically, as a result of dishing and corner rounding, three top recessed regions 254*c*-1', 254*c*-2', and 254*c*-3' have been formed. Additionally, each of the top recessed regions 254*c*-1, 254*c*-2, and 254*c*-3 falls below the top surface 254*c* of the copper metallization line 254 as well as the oxide region 250*c*. Furthermore, due to corner rounding, the sharp corners 254*b* and 254*a* have been replaced by rounded corners.

Simply stated, the dishing effect in copper metallization lines ultimately results in corner rounding. That is, first, dishing causes the top recessed region 254*c*-1 to be formed, which in turn, results in the exposure of the sharp corners 254*b* and 254*a*. Once exposed, the application of the polishing pad 108 and the asperities 108*a* onto the sharp corners 254*b* and 254*a* results in the oxide removal from the intersection of the boundary sidewalls 255*b* and 255*a* and oxide regions 250*c* and 250*d*, respectively, and therefore, in rounding of the sharp corners 254*b* and 254*a*. However, the rounding of the sharp corners 254*b* and 254*a* itself leads to the formation of top recessed regions 254*c*-2 and 254*c*-3, thus exposing more of the sharp corners 254*b* and 254*a*. Consequently, the continuous application of the polishing pad 108 and the asperities 108*a* causes additional oxide to be removed, thus deepening the top recessed regions 254*c*-2 and 254*c*-3. In this manner, a cycle is created. Nonetheless, as a result of the oxide region 250*c* being wide, the resulting oxide region 250*c*' does not entirely fall below the level of the heterogeneous top surface 250*a'*.

In contrast, where the oxide region is narrow, the corner rounding and thus dielectric erosion cause the resulting oxide region to fall below the level of the heterogeneous top surface 250*a*'. This is illustrated in the enlarged, partial, cross-sectional view of the post-CMP dielectric layer 250' of prior art FIG. 3D, depicting the dielectric erosion of a distant "H" of the oxide region 250*b*. As shown, the high selectivity of $K_p$ of copper over $K_p$ of oxide has caused the narrow oxide region 250*b* to be removed at the same removal rate as copper. As such, the resulting oxide region 250*b*' is defined below the level of the heterogeneous top surface 250*a'*.

Corner rounding and the related dielectric erosion can further be understood with respect to the prior art FIGS. 4A–4E illustrating the dishing effect being maturated into the corner rounding effect. As shown in the enlarged, partial, cross-sectional view of FIG. 4A, while the polishing pad 108 is static, the polishing pad 108 rests upon a portion of the top surface 254*c* of the copper metallization line 254, the sharp corner 254*b*, and the oxide region 250*c*. While static, the polishing pad 108 does not engage the boundary sidewall 255*b*, and the polishing pad 108 significantly protrudes above the boundary sidewall 255*b* and the top surface 254*c*.

Once the polishing pad 108 starts to move in the movement direction 262, as depicted in FIG. 2B, the Polishing pad 108 intrudes, thus contacting the upper portion of the boundary sidewall 255*b*. As shown in FIG. 4C, while moving, the polishing pad 108, and thus the asperities 108*a* engage the upper portion of the sidewall 255*b* and the sharp corner 254*b*, creating a rounded corner 254*b*-1'. In this manner, corner rounding causes oxide removal along the upper portion of a boundary sidewall 255*b*-1', the rounded corner 254*b*-1', and an oxide region 250*c*-1'. As illustrated in FIG. 4D, due to corner rounding and dielectric erosion, the resulting boundary sidewall 255*b*-2' as well as the resulting oxide region 250*c*-2' are shorter than the boundary sidewall 255*b* and the oxide region 250*c*, respectively. Furthermore, as shown, a rounded corner 254*b*-2' has been formed.

The origin of corner rounding and dielectric erosion can further be understood in reference to prior art FIG. 4E. As shown, once the polishing pad 108 deforms as it comes into contact with the upper portion of the boundary sidewall 255*b*, the kinetic energy of the relative motion of the polishing pad 108 is converted into pad/feature corner interaction energy, thus creating a plurality of force vectors F1–F7. Depending on their distance from the sharp corner 254*b*, the sizes of the force vectors F1–F7 vary. The largest force vector F1 is the force vector closest to the sharp corner 254*b*, and is created at a point the polishing pad 108 engages the sharp corner 254*b* most significantly. As a result, corner rounding and dielectric erosion are most pronounced in the oxide region adjacent to the sharp corner 254*b*. Comparatively, the smallest force vector F7 is the force vector farthest removed from the sharp corner 254*b*, and is created where the pad engagement is least significant, thus creating the least degree of corner rounding. Hence, as the polishing pad engages the sharp corners, the CMP of the oxide layer having heterogeneous surfaces results in copper metallization lines loss as well as oxide erosion.

Starting from the first copper metallization layer, the negative effects of dishing, corner rounding, and dielectric erosion mainly caused by the polishing pad roughness features and asperities result in an uneven post-CMP surface topography. This unevenness of surface topography escalates into a more varied and complicated topography as additional layers are formed and planarized. Additionally, because the metallization content in each line is not uniform, it is not possible to use modeling parameters to define how a device will function as a finished product. As can be appreciated, defective semiconductor structures ultimately lead to the discarding of valuable wafers, thus reducing costly throughput.

In view of the foregoing, a need therefore exists in the art for an assembly for use in a chemical mechanical planarization (CMP) system that maximizes the planarization uniformity by improving the polishing pad performance while minimizing the damaging effects of dishing, corner rounding, and dielectric erosion.

SUMMARY OF THE INVENTION

Broadly speaking, the present invention fills these needs by apparatuses and related methods for ironing a post-conditioned surface of a polishing pad, thus minimizing the damaging effects of dishing, corner rounding, and dielectric erosion caused by the pad surface roughness features. Preferably, the CMP system is designed to implement an ironing assembly to flatten the pad surface roughness features formed on a post-conditioned surface of the polishing pad. The pad surface roughness features are herein defined as "asperities." In preferred embodiments, the ironed asperities are flattened such that they lay substantially at the same level as the surface of the post-conditioned polishing pad. It should be appreciated that the present invention can be implemented in numerous ways, including as a process, an apparatus, a system, a device, or a method. Several inventive embodiments of the present invention are described below.

In one embodiment, a method for smoothing a surface of a polishing pad previously used in planarizing a surface of a substrate in a chemical mechanical planarization (CMP) system is disclosed. The method starts by conditioning the surface of the polishing pad so as to create a post-conditioned surface having an asperity. The post-conditioned surface of the polishing pad is then ironed, thus compressing the asperity onto the post-conditioned surface of the polishing pad such that the asperity lays substantially flat against the post-conditioned surface of the polishing pad.

In another embodiment, a method for smoothing a surface of a polishing pad previously used in planarizing a surface of a substrate in a chemical mechanical planarization (CMP) system is disclosed. The method starts by conditioning the surface of the polishing pad so as to create a post-conditioned surface having a plurality of asperities. The post-conditioned surface of the polishing pad is then ironed, thus compressing the plurality of asperities onto the post-conditioned surface of the polishing pad such that the plurality of asperities lay substantially flat against the post-conditioned surface of the polishing pad.

In still a further embodiment, an ironing assembly for use in a chemical mechanical planarization (CMP) apparatus is disclosed. The ironing assembly is designed to be used over a polishing pad having a post-conditioned surface that includes a plurality of asperities. The ironing assembly includes an ironing disk, an ironing head and an ironing track bar. The ironing disk has a contact surface and is oriented over the polishing pad such that the contact surface of the ironing disk is applied onto the post-conditioned surface of the polishing pad. The ironing head has a base coupled to the track bar and a bottom surface coupled to a non-contact surface of the ironing disk. The ironing disk is applied onto the post-conditioned surface of the polishing pad as the ironing base moves along the ironing track bar and the polishing pad moves along a direction of rotation. The application of the contact surface of the ironing disk onto the post-conditioned surface acts to at least partially flatten the plurality of asperities.

In yet another embodiment, an ironing assembly for use in chemical mechanical planarization (CMP) is disclosed. The ironing assembly is designed for use over a linear polishing pad having a plurality of asperities and applied slurry. The ironing assembly includes an ironing disk having a contact surface. The ironing disk is oriented over the linear polishing pad such that the contact surface of the ironing disk can be applied over the surface of the linear polishing pad, thus at least partially flattening the plurality of asperities before planarizing a semiconductor wafer surface over the linear polishing pad.

In yet another embodiment, an apparatus for use in a chemical mechanical planarization (CMP) system so as to improve the planarization uniformity of the CMP system is disclosed. The apparatus includes a polishing pad previously used in polishing a surface of a substrate, a track bar, an arm, a conditioning assembly, and an ironing assembly. The arm has a first point and a second point that is separate from the first point such that the arm is coupled to the track bar at the first point. The conditioning assembly has a conditioning base that is coupled to the arm at a conditioning point defined between the first point and the second point. The conditioning assembly is configured to condition the polishing pad so as to create a post-conditioned surface having a plurality of asperities. The ironing assembly has an ironing base that is coupled to the arm at an ironing point defined between the first point and the second point. The conditioning point is configured to precede the ironing point.

The advantages of the present invention are numerous. Most notably, by significantly reducing the damaging effects of dishing, corner rounding, and dielectric erosion caused by the asperities on the surface of the post-conditioned polishing pad, the ironing system of the present invention significantly improves the planarization uniformity of the polishing pad. In eliminating these negative effects, the ironing system of the present invention extensively contributes to successfully implementing modeling parameters to assess the quality of a finished multi-level semiconductor device having copper metallization lines. In this manner, better quality semiconductor devices can be fabricated thus reducing the number of defective wafers, which ultimately increases the throughput.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

FIG. 5D-1 is an enlarged, partial, cross-sectional view showing the curved circumference portion of an exemplary ironing disk flattening a plurality of asperities formed over a surface of the post-conditioned polishing pad, in accordance with one aspect of the present invention.

FIG. 5D-2 is a simplified, partial, enlarged, cross-sectional view, showing a significantly protruding asperity being compressed onto the surface of the post-conditioned polishing pad, in accordance with another aspect of the present invention.

FIG. 5D-3 a simplified, partial, enlarged, cross-sectional view, depicting a flattened asperity laying against a surface of the post-conditioned polishing pad, in accordance with yet another embodiment of the present invention.

DETAILED DESCRIPTION OF EXEMPLARY EMBODIMENTS

Embodiments of a pad ironing system for optimizing planarization uniformity while minimizing damaging effects of dishing, corner rounding, and dielectric erosion are described. The pad ironing system preferably implements an ironing head to flatten the asperities formed on the surface of the post-conditioned polishing pad, thus smoothing the post-conditioned surface of the polishing pad. In preferred embodiments, the asperities are compressed onto the post-conditioned surface of the polishing pad such that as flattened, the asperities are defined on substantially the same level as the surface of the post-conditioned polishing pad.

In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 5A:
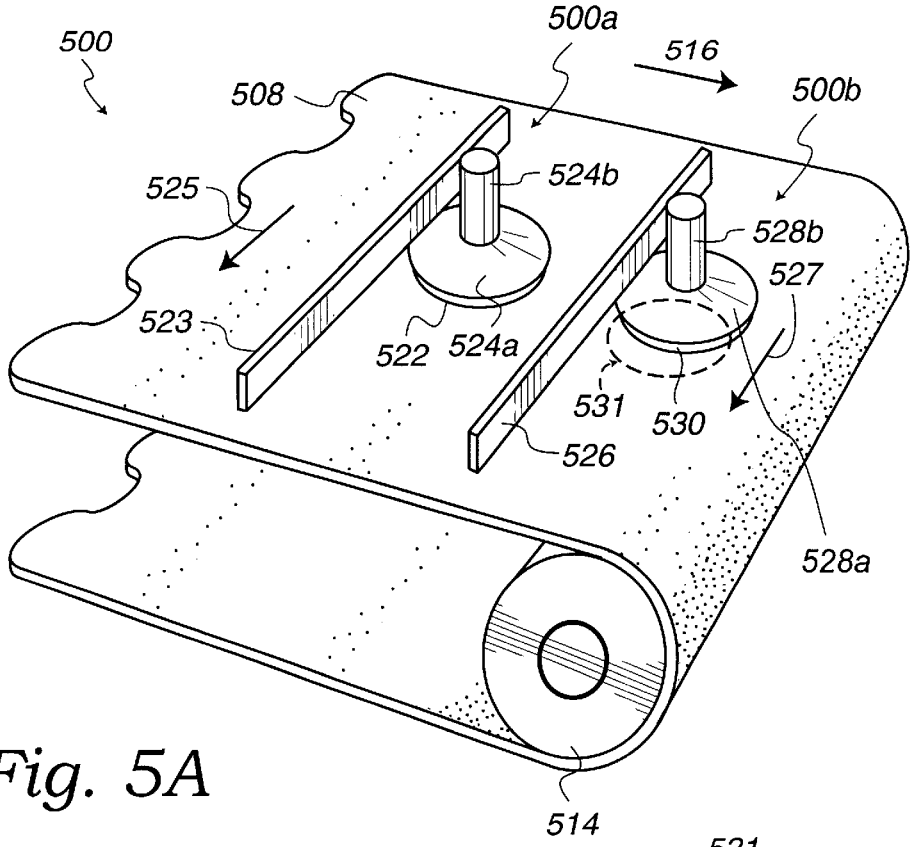
FIG. 5A is a simplified, partial, isometric view of a belt-type chemical mechanical planarization system utilizing an independent ironing assembly, in accordance with one embodiment of the present invention.

FIG. 5A is a partial, simplified, isometric view of a belt-type chemical mechanical planarization system 500 utilizing an independent ironing assembly 500*b*, in accordance with one embodiment of the present invention. As shown, a belt-type pad 508 moving in a rotation direction 516 is first conditioned by a conditioning assembly 500*a*. Thereafter, the post-conditioned surface of the polishing pad 508 is smoothed by the ironing assembly 500*b*.

As shown, the conditioning assembly 500*a* includes a conditioning disk 522 mounted on a conditioning head 524*a* that is coupled to a conditioning base 524*b*. A contact surface of the conditioning disk 522 is flat and is configured to include a plurality of diamonds (not shown in this Figure) thereon. The polishing pad 508 is conditioned as the conditioning base 524*b* and thus the conditioning head 524*a* move along a conditioning track bar 523 across the polishing pad surface 508 in a movement direction 525.

Similarly, the ironing assembly 500*b* includes an ironing disk 530 mounted on an ironing head 528*a* having an ironing base 528*b*. In this embodiment, a contact surface of the ironing disk 530 is configured to have an inner circular flat portion and a curved circumference portion. The polishing pad 508 is ironed as the ironing base 528*b* and the ironing head 528*a* are moved along an ironing track bar 526 across the polishing pad 508 in the movement direction 527.

As shown, in this implementation, the wafer application region (not shown in this Figure) precedes both the contact surfaces of the conditioning assembly 500*a* and the ironing assembly 500*b* with the polishing pad 508. In addition, the contact surface of the conditioning assembly 500*a* with the polishing pad 508 precedes the contact surface of the ironing assembly 500*b* with the polishing pad 508. In this manner, the pad 508 is configured to be ironed after the polishing pad 508 has been conditioned and before the post-conditioned polishing pad 508 is applied onto the surface layers of the wafer, thus optimizing the smoothing operation performed on the pad surface roughness features, asperities, formed over the surface of the polishing pad 508 during the conditioning operation. Additional details regarding the function of the ironing assembly 500*b* are set forth below in connection with the description of FIGS. 5D-1 through 5D-3.

In one embodiment, the conditioning head 524*a* and the ironing head 528*a* move along their respective track bars 523 and 526 simultaneously. In this manner, due to the polishing pad 508 moving in the movement direction 516, the smoothing operation of the ironing assembly 500*b* achieves an optimum result as the ironing operation is performed shortly after the conditioning head 528*a* conditions any given portion of the polishing pad 508. That is, at any given time, the ironing head 528*a* is configured to be applied to a portion of the polishing pad 508 that was conditioned instants before, causing the compression of the asperities formed due to the conditioning operation. However, although in this embodiment the ironing head 528*a* and the conditioning head 524 are configured to move across the polishing pad 508 almost simultaneously, in a different implementation, the movement of the ironing head 528*a* across the polishing pad 508 may be delayed.

As shown, to iron substantially all the asperities formed in the immediately preceding conditioning operation, the diameter of the conditioning disk 522 is configured to correlate with a diameter of a flat portion of the ironing disk 528*a*. Additional details regarding the design and function of the ironing disk 528*a* are set forth below in connection with the description of FIGS. 5B and 5C.

Figure 5B:
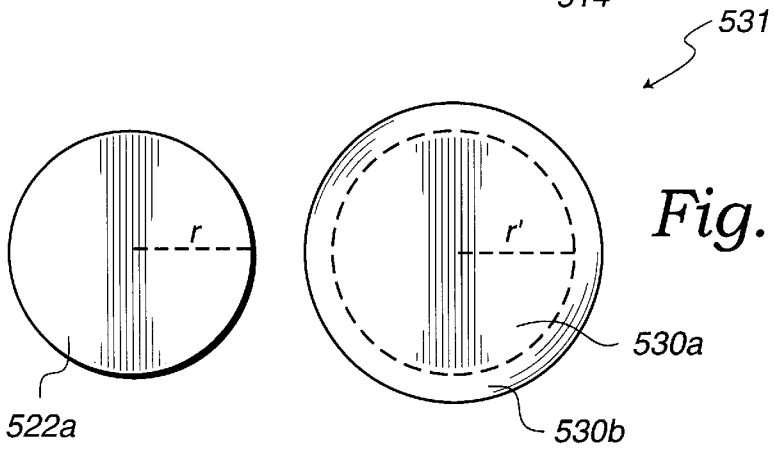
FIG. 5B is a top view of the ironing disk of an exemplary ironing assembly, in accordance with another embodiment of the present invention.
Figure 5C:
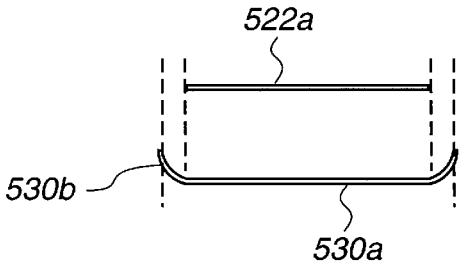
FIG. 5C is a cross-sectional view of the ironing disk of an exemplary ironing assembly, in accordance with yet another embodiment of the present invention.

The designs as well as the correlation in sizes of the conditioning disk 522 and the ironing disk 530 can further be understood with reference to FIGS. 5B–5C, respectively depicting the top and cross-sectional views of contact surfaces of the conditioning disk 522 and the ironing disk 530, in accordance with one embodiment of the present invention. As shown in FIG. 5B, the contact surface of the ironing disk 530 has an inner circular flat portion 530*a* having a radius "r'" and a circumference portion 530*b* having a curved surface. In preferred embodiments, the radius r' of the inner circular flat portion 530*a* of the ironing disk 530 is configured to be equivalent to a radius "r" of the contact surface 522*a* of the conditioning disk 522, thus giving the ironing disk 530 the capability to travel over and iron substantially all the asperities formed in the immediately preceding conditioning operation. In this manner, as the application of the conditioning disk 524*a* causes new asperities to be formed in one portion of the polishing pad 508, the asperities formed during the immediately preceding conditioning operation are being ironed. As such, the flattening of the asperities almost immediately subsequent to their formation advantageously minimizes the damaging effects of dishing, corner rounding and dielectric erosion.

Preferably, the ironing disk 530 is constructed from silicon carbide (SiC) and has a stainless steel backing. However, it must be appreciated that depending on a particular CMP process and a set of consumables, the ironing disk 530 may be constructed from any appropriate material that is wear resistant, sufficiently hard, and acceptable as clean room so long as it can perform the function of flattening the asperities formed over the post-conditioned polishing pad (e.g., quartz, silicon, ceramic materials (e.g., alumina, zirconia, etc.), etc.). Furthermore, the diameter of the ironing disk 530 ranges from approximately about 50 millimeters to approximately about 200 millimeters, with the radius of the curved surface of the circumference portion being approximately about 1 millimeter. In a like manner, the thickness of the silicon carbide portion of the ironing disk 530 is preferably approximately about 2 millimeters.

Figure 1:
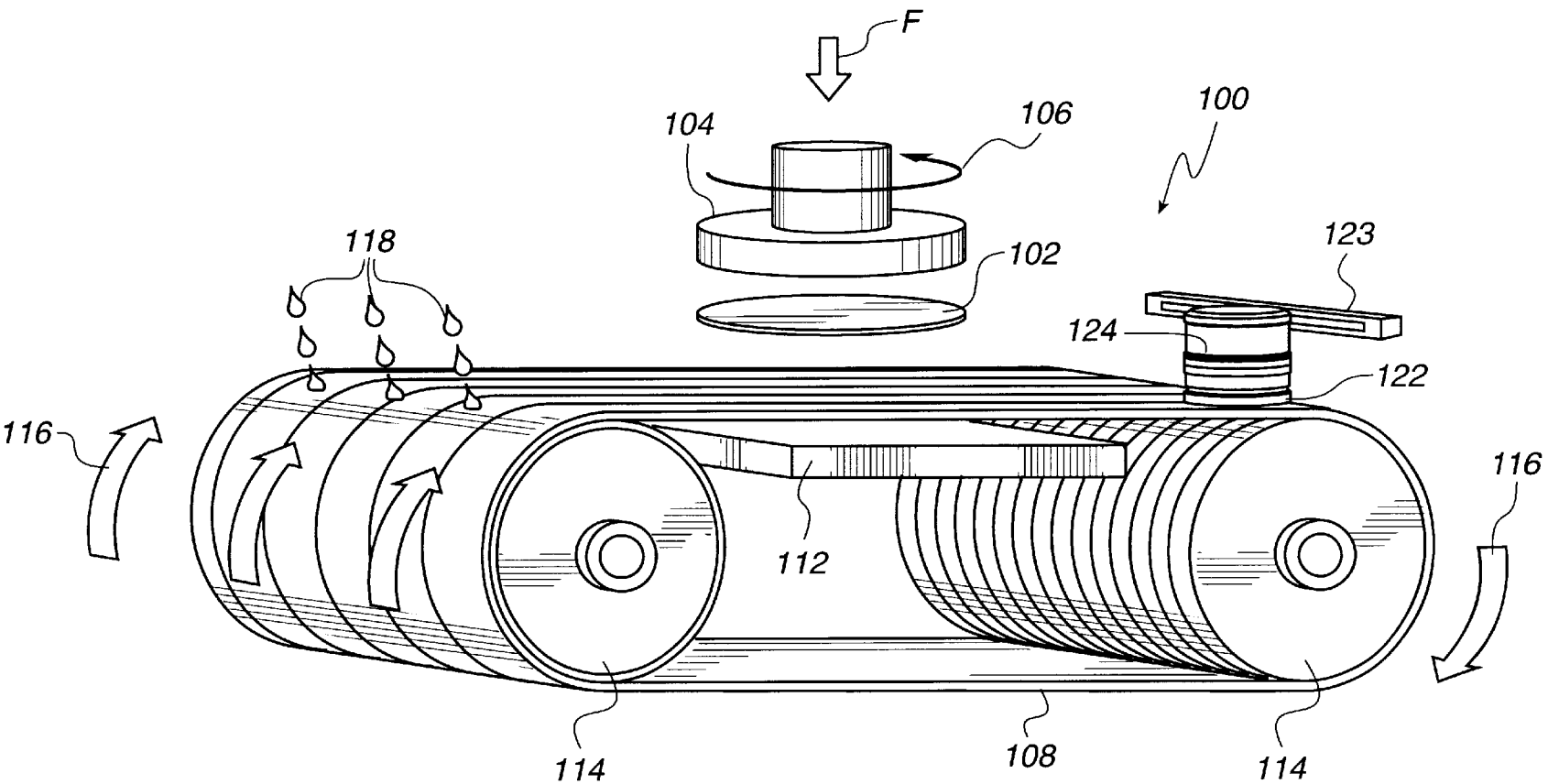
Fig. 1 (PRIOR ART)
FIG. 1 is an exemplary prior art CMP system.
Figure 2A:
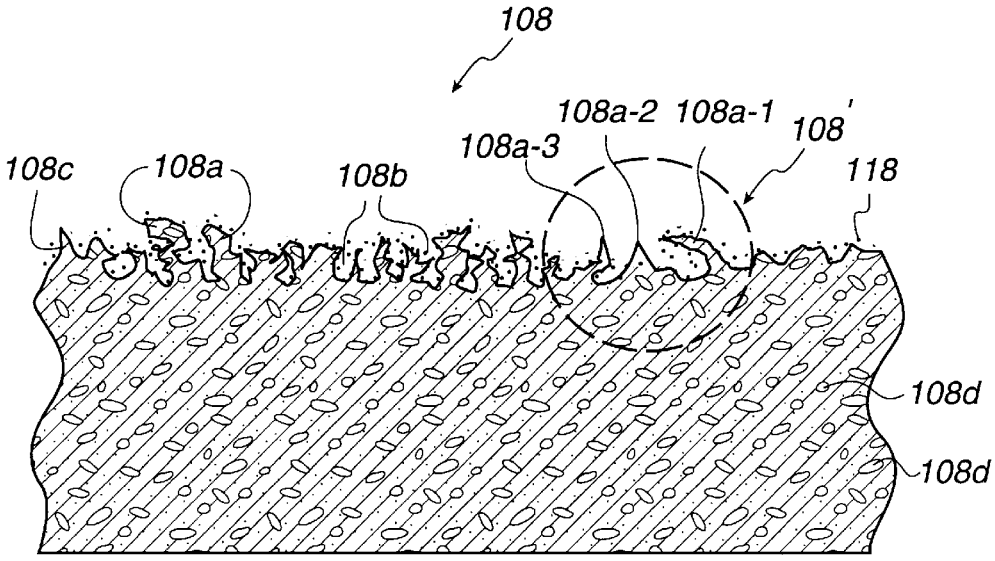
Fig. 2A (PRIOR ART)
FIG. 2A is a simplified, partial, enlarged, cross-sectional view of an exemplary prior art post-conditioned polishing pad.
Figure 2B:
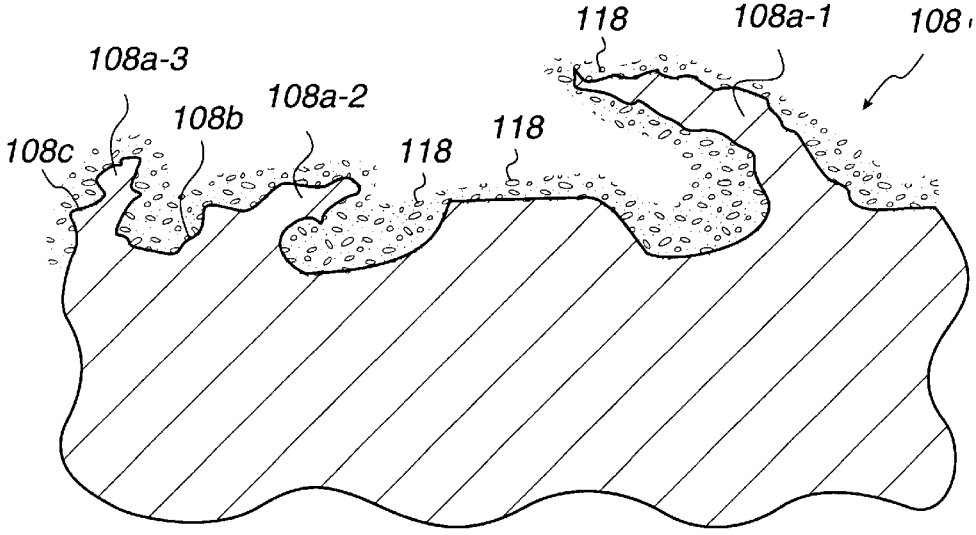
Fig. 2B (PRIOR ART)
FIG. 2B is a simplified, partial, enlarged, cross-sectional view of the exemplary prior art polishing pad of FIG. 2A.
Figure 3A:
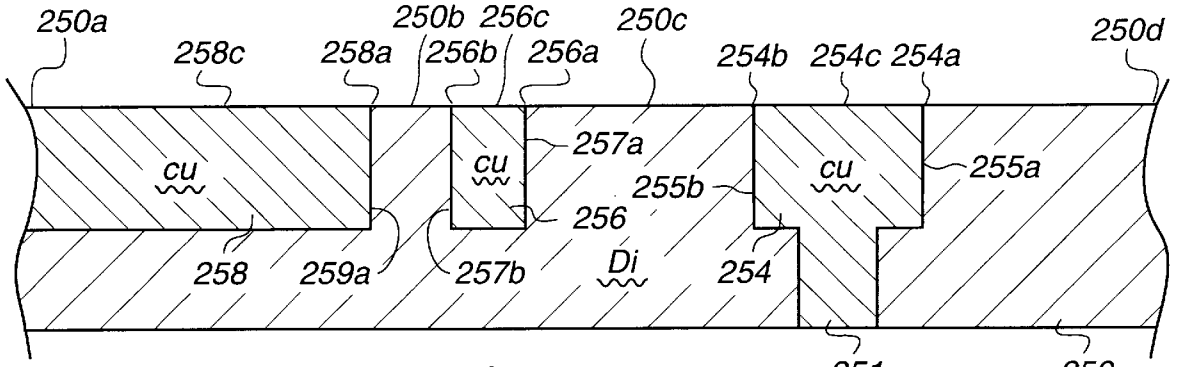
Fig. 3A (PRIOR ART)
FIG. 3A is an enlarged, partial, cross-sectional view of an ideal prior art post-CMP oxide layer having a heterogeneous top surface.
Figure 3B:
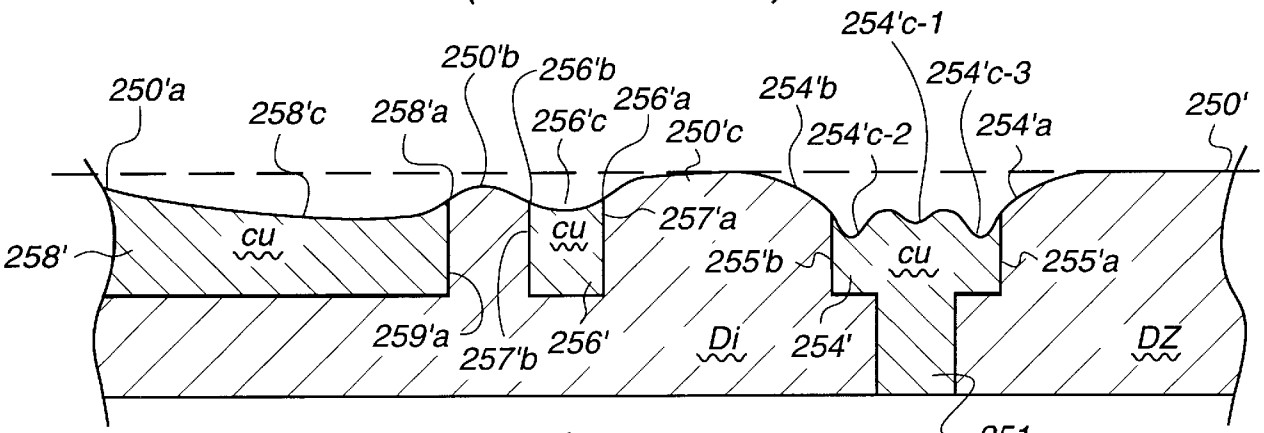
Fig. 3B (PRIOR ART)
FIG. 3B is an enlarged, partial, cross-sectional view of an exemplary prior art post-CMP oxide layer having a heterogeneous top surface.
Figure 3C:
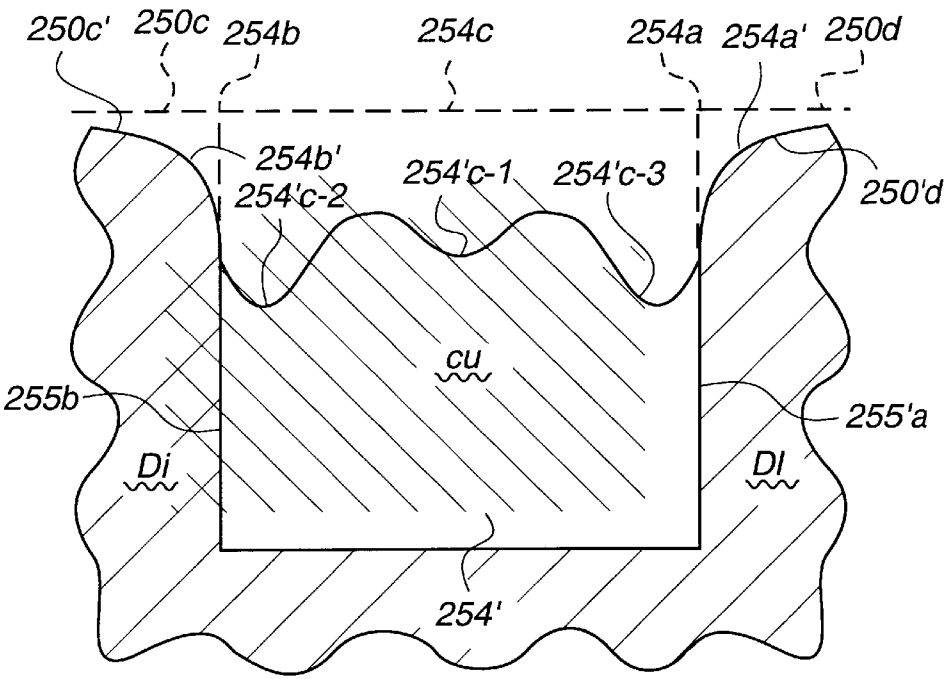
Fig. 3C (PRIOR ART)
FIG. 3C is an enlarged, partial, cross-sectional view, illustrating the concerted effects of dishing and corner rounding on an exemplary prior art wide copper metallization line and its adjacent wide oxide region.
Figure 3D:
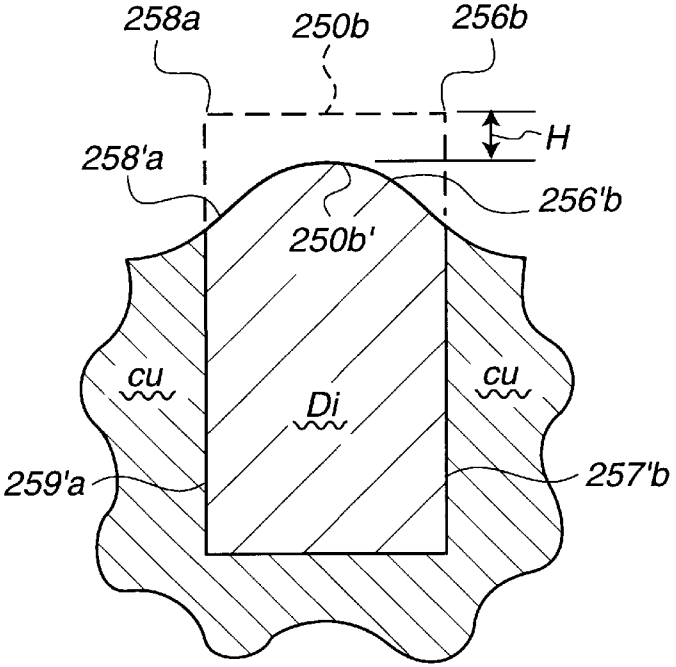
Fig. 3D (PRIOR ART)
FIG. 3D is an enlarged, partial, cross-sectional view of the prior art post-CMP dielectric layer of FIG. 3D, depicting the dielectric erosion of a distant "H" in a narrow oxide region.
Figure 4A:
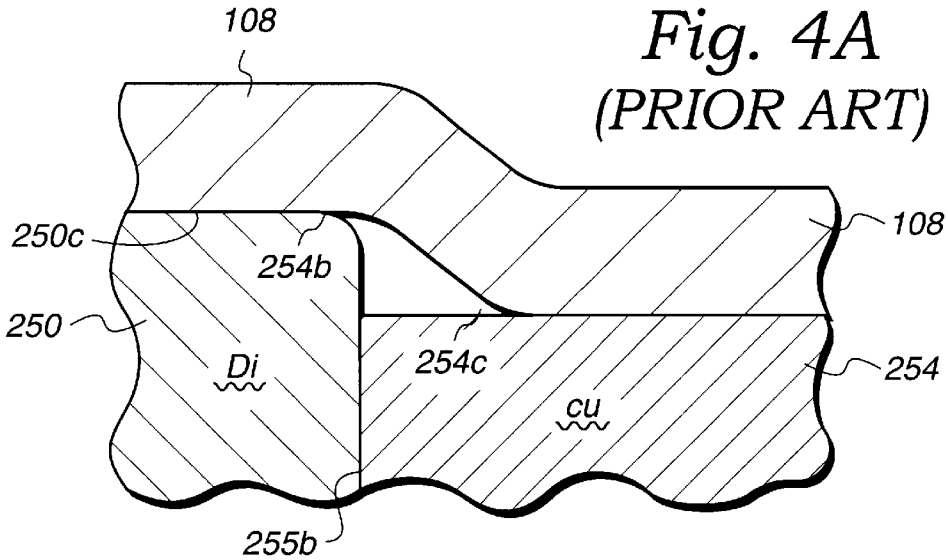
Fig. 4A (PRIOR ART)
FIGS. 4A–4E are enlarged, partial, cross-sectional views illustrating the maturation of dishing effect into corner rounding effect, in accordance with the prior art.
Figure 4B:
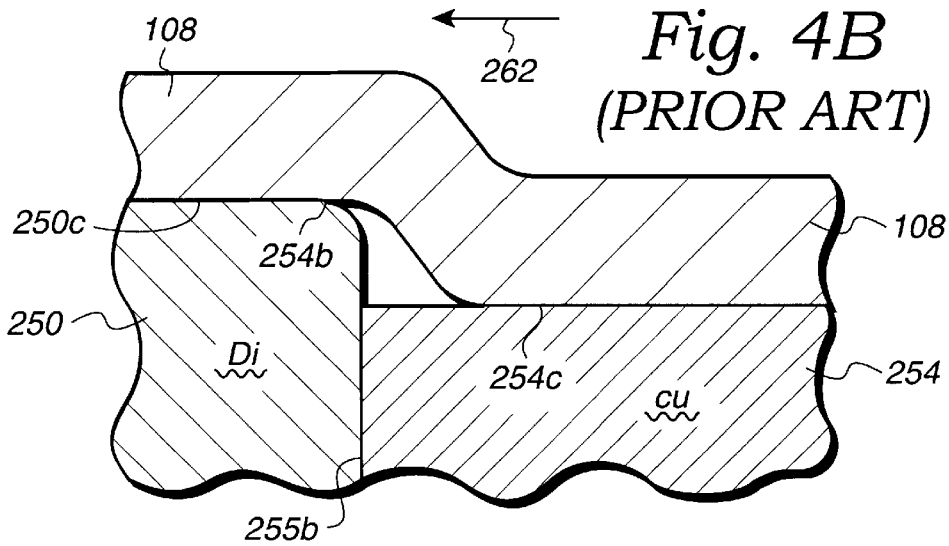
Fig. 4B (PRIOR ART)
Figure 4C:
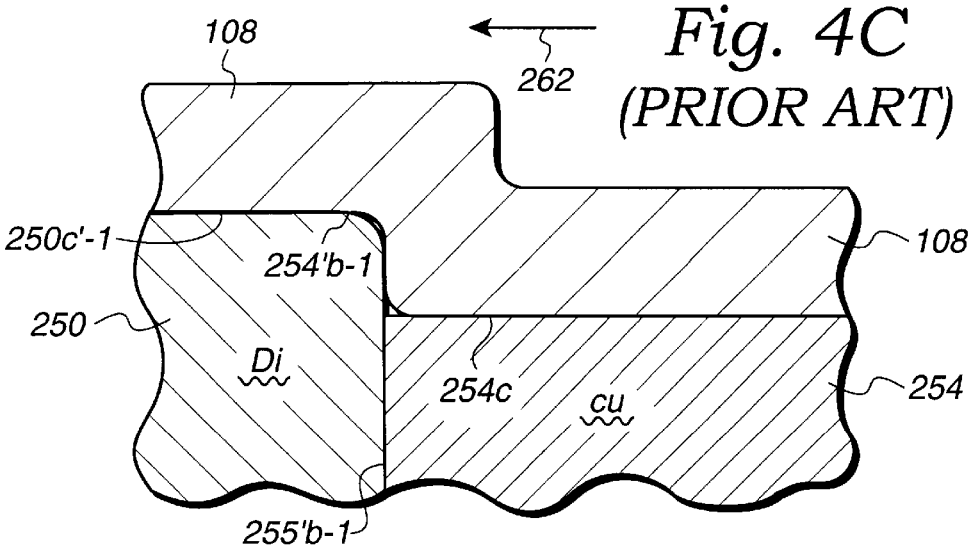
Fig. 4C (PRIOR ART)
Figure 4D:
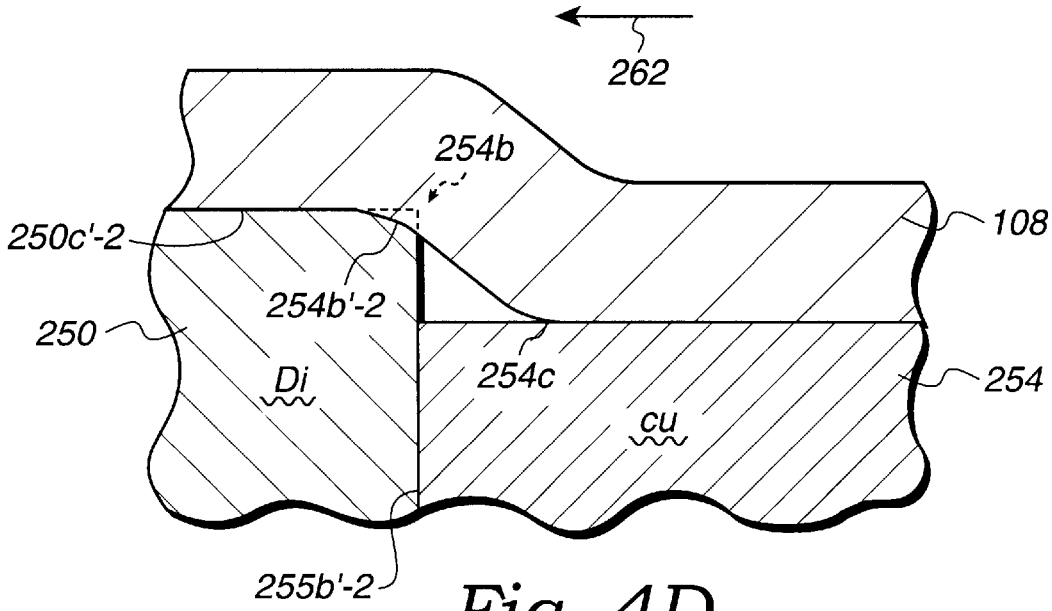
Fig. 4D (PRIOR ART)
Figure 4E:
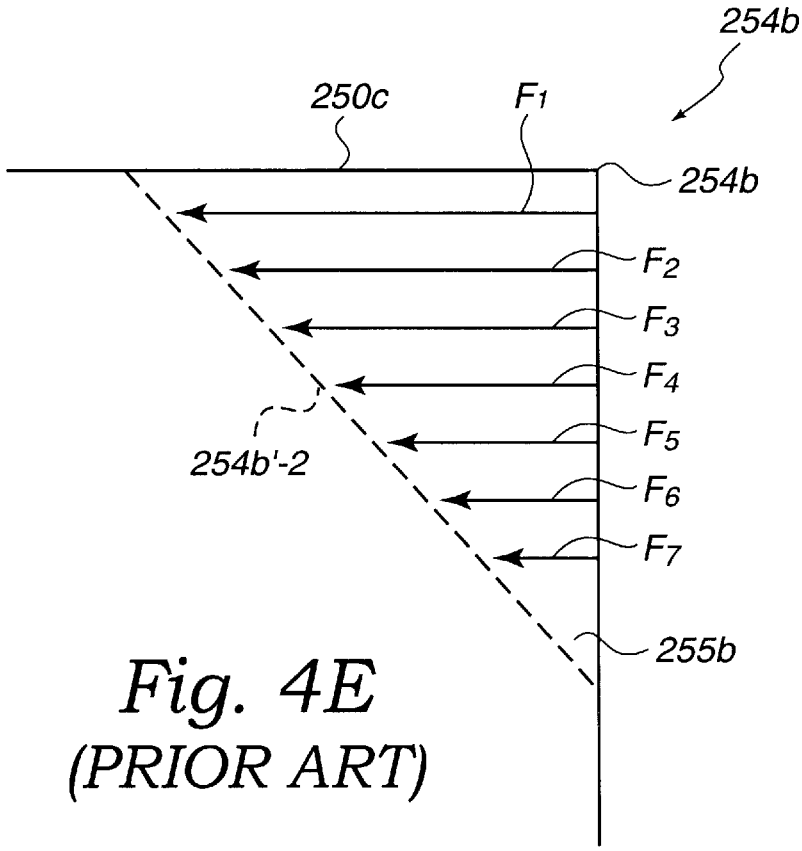
Fig. 4E (PRIOR ART)
Figures 1, 5D:
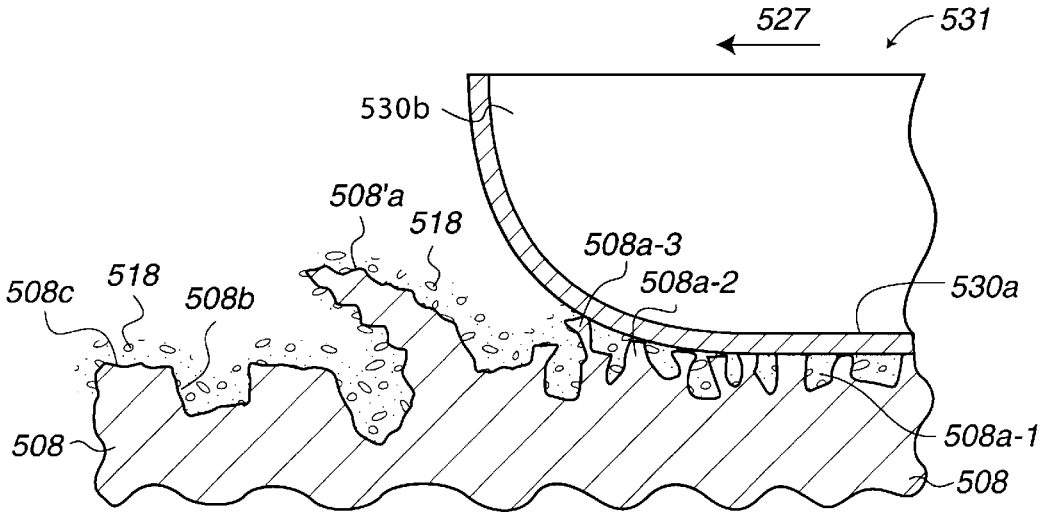
Figures 2, 5D:
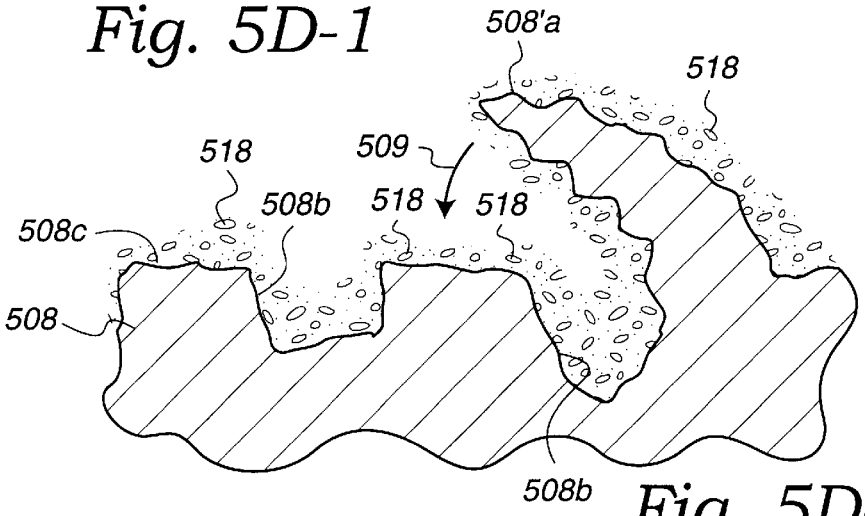

Reference is now made to the enlarged, simplified, partial, cross-sectional views of FIGS. 5D-1 through 5D-2, illustrating the curved surface 530*b* of the ironing disk 530 flattening a plurality of asperities 508*a*-1, 508*a*-2, 508*a*-3, and 508*a*' formed over a surface 508*c* of the post-conditioned polishing pad 508, in accordance with one embodiment of the present invention. As shown, the surface 508*c* of the polishing pad 508 includes a plurality of pores 508*b* and asperities 508*a*-1, 508*a*-2, 508*a*-3, and 508*a*' with the asperity 508*a*' significantly protruding above the surface 508*c*. A thin film of aqueous slurry 518 covers the surface 508*c* and thus the inside of the pores 508*b* and over the asperities 508*a*-1, 508*a*-2, 508*a*-3, and 508*a*'.

As shown, the asperity 508*a*-1 was ironed first. That is, first the circumference portion 530*b* of the ironing disk 530 crossed the asperity 508*a*-1 compressing it down onto the surface 508*c*. This was then followed by the inner circular flat portion 530*a* traveling over the compressed asperity 508*a*-1 causing the asperity 508*a*-1 to lay substantially flat. As illustrated, subsequent to being ironed, the asperity 508*a*-1 is defined almost in the same level as the surface 508*c*. As shown, the asperities 508*a*-2 and 508*a*-3, and 508*a*' are next in line to be traveled over and ironed by the circumference portion 530*b* and subsequently the inner circular flat portion 530*a*.

Figures 3, 5D:
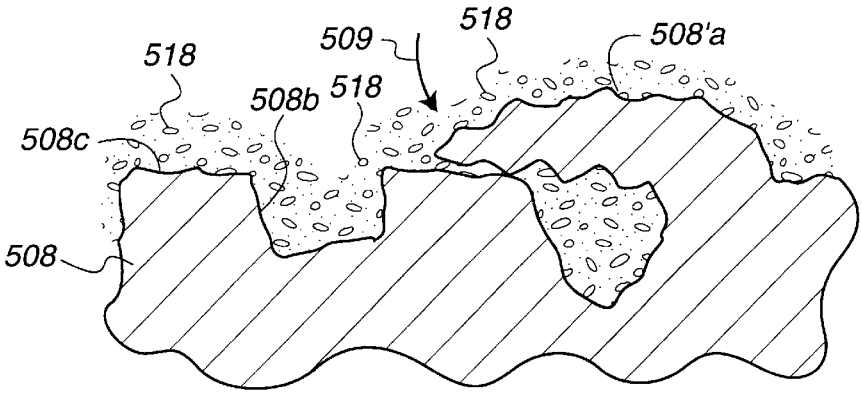

The application of the ironing disk 530 on a protruding asperity 508*a*' formed over the surface 508*c* of the polishing pad 508 is specifically illustrated in FIG. 5D-2 through 5D-3. As shown in FIG. 5D-2, once the ironing disk 530 comes into contact with the protruding asperity 508*a*', it applies force on the asperity 508*a*', thus causing the asperity to be moved in a movement direction 509 toward the surface 508*c*. Due to the aqueous slurry 518 being present, an adhesive force is created between the asperity 508*a*' and the aqueous slurry 118 causing the asperity to remain flat once it has been compressed. This adhesive force is further enhanced by the vacuum force created as a result of ejection of the aqueous slurry 518 located within the pore 508*b* defined adjacent to the compressed asperity 508*a*'. In this manner, as shown in FIG. 5D-3, subsequent to being ironed, the asperity 508*a*' lays flat such that it is disposed substantially in the same level as the surface 508*c*.

Figure 6A:
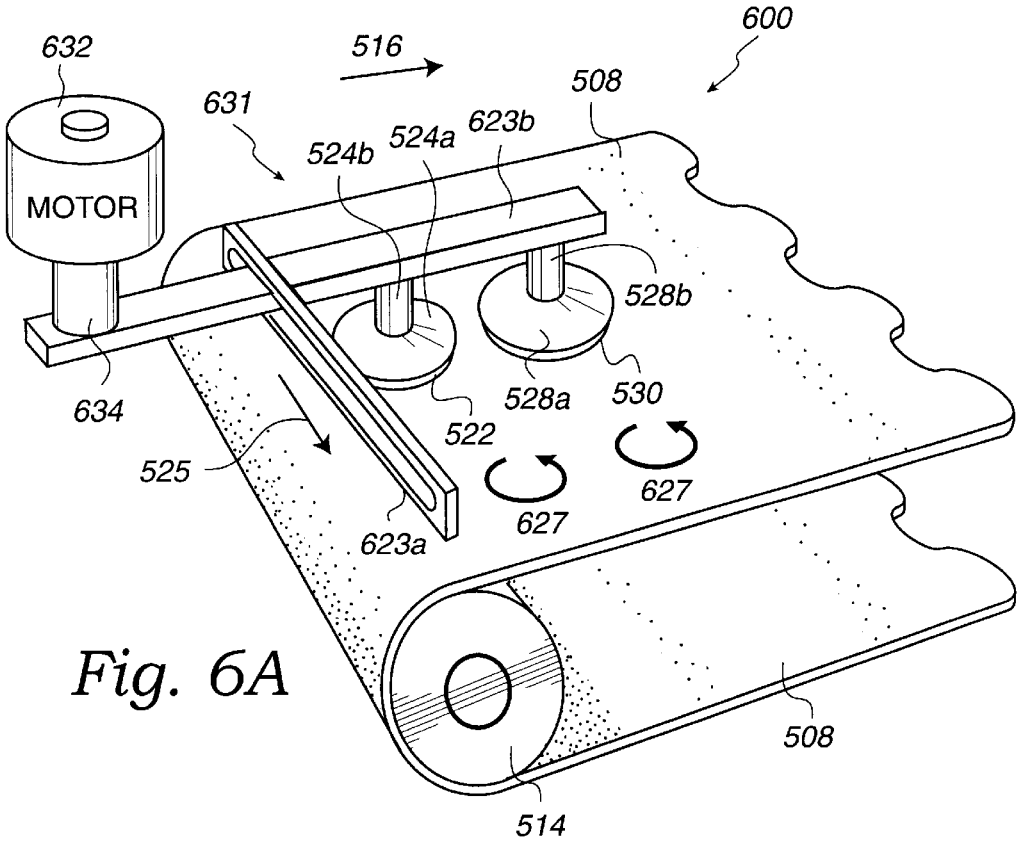
FIG. 6A is a partial, simplified, isometric view of a belt-type chemical mechanical planarization system utilizing a conditioning-ironing assembly, in accordance with another embodiment of the present invention.

FIG. 6A is a partial, simplified, isometric view of a belt-type chemical mechanical planarization system 600 utilizing a conditioning-ironing assembly 631, in accordance with another embodiment of the present invention. As shown, in this implementation, the conditioning head 524*a* and the ironing head 530*a* are mounted on an arm 623*b* utilizing bases 524*b* and 528*b*, respectively, and are configured to rotate in a rotation direction 627. As shown, the arm 623*b* and thus the conditioning head 524*a* and the ironing head 528 move along a track bar 623*a* across the polishing pad 508 in a movement direction 525. A motor 532 connected to the track bar 623*a* with a shaft 634 is configured to drive the arm 623*b* along the track bar 623*a*.

In this example, the contact surfaces of the conditioning disk 522 and ironing disk 530 precede the wafer application region. Hence, in this embodiment, the conditioning-ironing assembly 631 flattens the post-conditioned polishing pad 508 before the polishing pad 508 contacts the surface of the wafer, thus optimizing the effects of the conditioning an ironing of the polishing pad 508.

Figure 6B:
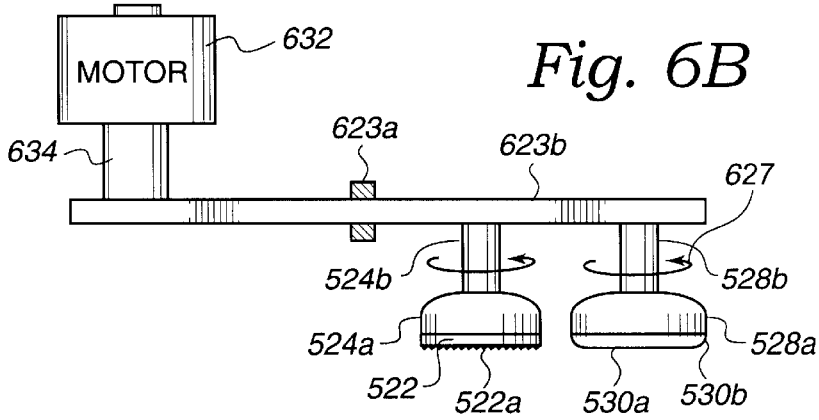
FIG. 6B is a simplified, enlarged, cross-sectional view of an exemplary conditioning-ironing assembly, illustrating the side-by-side positions of the conditioning head and the ironing head, in accordance with yet another embodiment of the present invention.

In being parts of the same conditioning-ironing assembly 631, the conditioning head 524*a* and the ironing head 530*a* are positioned on the post-conditioned polishing pad 508 side-by-side, thus substantially synchronizing the conditioning and ironing operations. This has been illustrated in a simplified, enlarged, cross-sectional view of the conditioning-ironing assembly 631 of FIG. 6B. In moving in unison, the ironing operation of the ironing head 528*a* is optimized, as the ironing head 528*a* can almost immediately flatten the asperities formed by the conditioning disk 522 instants before, thus further enhancing the quality of the ironing operation.

Figure 7A:
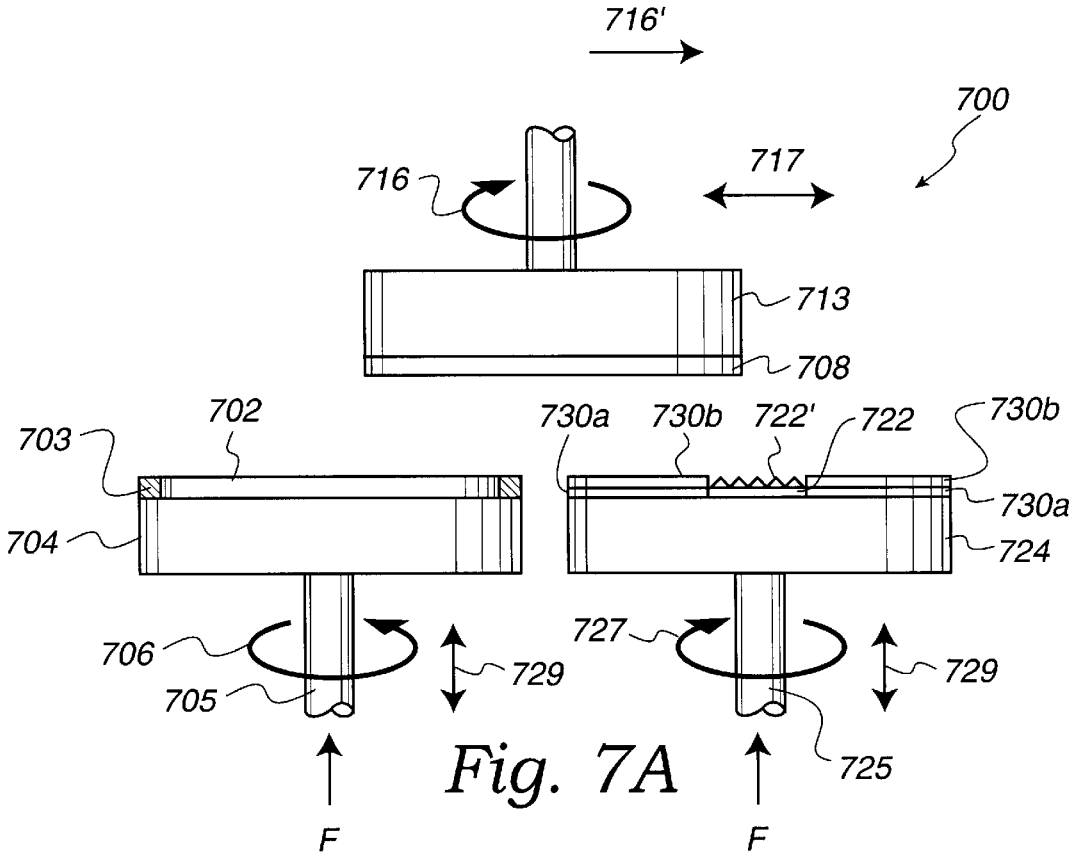
FIG. 7A is a simplified cross-sectional view of a Variable Partial Overlapping (i.e., subaperture) CMP system, in accordance with one embodiment of the present invention.

FIG. 7A is a simplified cross-sectional view of a Variable Partial Overlapping (i.e., subaperture) CMP system 700, in accordance with one embodiment of the present invention. The embodiment of FIG. 7A includes a polishing head 713 which is configured to planarize the surface of a wafer 702 as the polishing head 713 rotates in a polishing direction 716 and moves from the center of the wafer 702 to the edge of the wafer 702 in a movement direction 716'. The polishing head 713 is further configured to create an oscillating movement by moving back and forth in an oscillation direction 717. In this implementation, a carrier 704 is defined below the polishing head 713 and is configured to engage the wafer 702 using a retainer ring 703 such that the exposed surface of the wafer 702 faces the polishing head 713. In one exemplary embodiment, while the wafer 702 is being polished by a polishing pad 708, the retainer ring 703 is configured to maintain a co-planer relationship with the wafer 702. As shown, during the CMP operation, a spindle 705 is configured to apply a force F on the carrier head 704 in a direction 729. Furthermore, during the CMP operation, the carrier 704 is configured to rotate in a wafer rotation direction 706, a direction opposite to the polishing direction 716.

The subaperture CMP system further includes a conditioning-ironing head 724 designed to be positioned to the right (or any side) of the carrier 704 and below the polishing head 713 so as to condition and iron the polishing pad 708. In this embodiment, the conditioning and ironing operations are respectively performed by a diamond grid 722' and ironing sectors 730*b*. As shown, the diamond grid 722' is mounted on a conditioning plate 722, which in turn is coupled to the conditioning-ironing head. In a like manner, the ironing sectors 730*b* are mounted on backings 730*a* which in turn are secured to the conditioning-ironing head 724. A spindle 725 is configured to apply a force F onto the conditioning-ironing head 724 in the direction 729 while the conditioning-ironing head 724 rotates in the conditioning direction 727. As shown, the conditioning head is configured to rotate in the same direction as the polishing head 716.

Figure 7B:
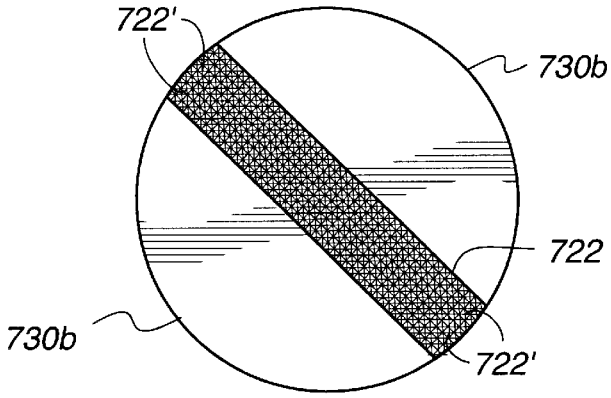
FIG. 7B is a simplified top-view of a conditioning-ironing head of the subaperture CMP system shown in FIG. 7A, in accordance with yet another embodiment of the present invention.

Accordingly, at any given time, while a portion of the polishing pad 708 is planarizing the surface of the wafer 702, the conditioning diamond grid 722' of the conditioning-ironing head 724 unclogs and roughens a different portion of the surface of the polishing pad 708 (i.e., the portion that is not being applied on the wafer 702), thus creating asperities. However, almost immediately after the asperities are formed, the asperities are flattened by the application of the ironing sectors 730*b* on the post-conditioned polishing pad 708. Namely, due to being parts of the same rotating unit, the ironing sectors 730*b* immediately follow the conditioning grid 722', thus maximizing the planarization uniformity of the subaperture CMP system. As shown in the enlarged, simplified, top view of the conditioning head 724 of FIG. 7B, in this embodiment the conditioning and ironing of the polishing pad 708 is performed within instants, as the ironing sectors 730*b* substantially encircle the conditioning grid 722'.

For additional information on subaperture CMP systems, reference can be made to: U.S. patent application Ser. No. 09/644,135, filed on Aug. 22, 2000, having inventors Miguel A. Saldana, John M. Boyd, Yehiel Gotkis, and Aleksander A. Owczarz, and entitled "SUBAPERTURE CHEMICAL MECHANICAL POLISHING SYSTEM." This U.S. Patent Application, which is assigned to Lam Research Corporation, the assignee of the subject application, is incorporated herein by reference.

Figure 8A:
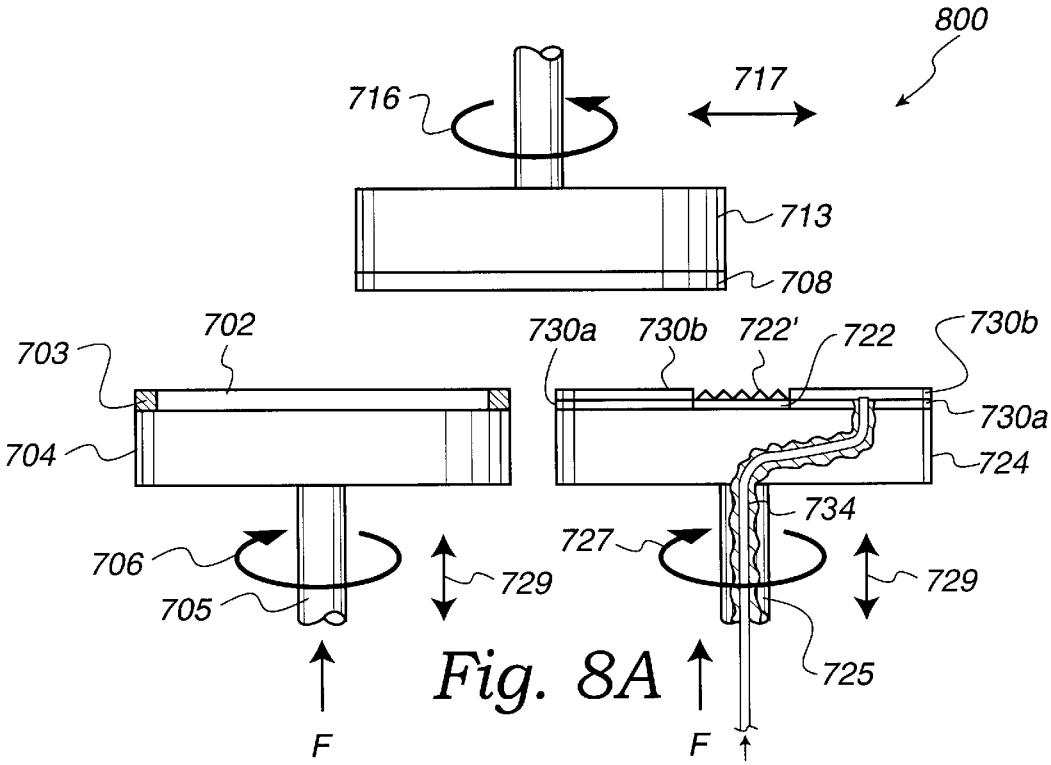
FIG. 8A is a simplified cross-sectional view of a subaperture CMP system wherein the conditioning-ironing head includes brushes, diamond grid, and ironing disks, in accordance with yet another embodiment of the present invention.
Figure 8B:
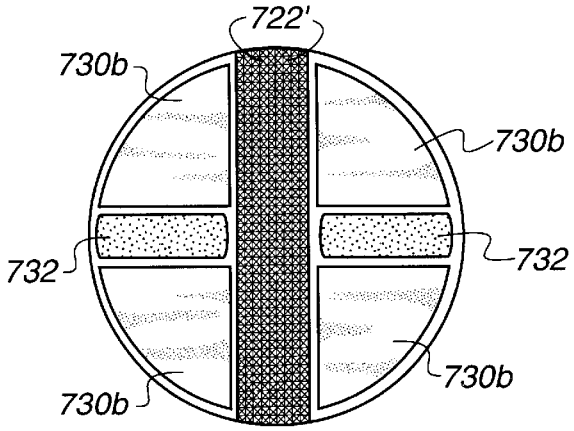
FIG. 8B is a simplified top-view of the conditioning-ironing head of the subaperture CMP system shown in FIG. 8A, in accordance with yet another embodiment of the present invention.

Reference is now made to a simplified cross-sectional view of a subaperture CMP system 800 of FIG. 8A wherein the conditioning-ironing head 724 further includes brushes 732, in accordance with another embodiment of the present invention. As shown, in addition to the ironing sectors 730*b* and diamond grid 722', brushes 732 have been secured on the conditioning-ironing head 724 so as to enhance the CMP operation. In this example, a delivery tube 733 coupled to the brushes 732 is configured to supply a cleaning fluid to the brushes 732. As shown, in this implementation, the delivery tube 733 is inserted through the spindle 725 and is defined within the conditioning-ironing head 724. The respective positions of the conditioning grid 722', ironing sectors 730*b*, and brushes 732 of the subaperture CMP system 800 are further illustrated in the simplified, enlarged, top view of the conditioning-ironing head 724 depicted in FIG. 8B, in accordance to one embodiment of the present invention.

Although in this embodiment the cleaning fluid is supplied to the brushes 732 through a delivery tube 725 defined within the conditioning-ironing head 724, it must be appreciated that any appropriate method may be used to introduce the cleaning fluid onto the conditioning-ironing interface. Furthermore, it must be understood that besides the brushes 732, any number of appropriate additional features may be included on the conditioning-ironing head 724 (e.g., slurry distribution port, polishing pad surface roughness/staining detection unit, polishing pad temperature control sensor, etc.). Furthermore, it must be appreciated that the conditioning grid 722', ironing sectors 730*b*, and brushes 732 may be secured to the conditioning-ironing head 724 in any configuration so long as the quality of the ironing and conditioning operations of the conditioning-ironing head are satisfactory.

Figure 9:
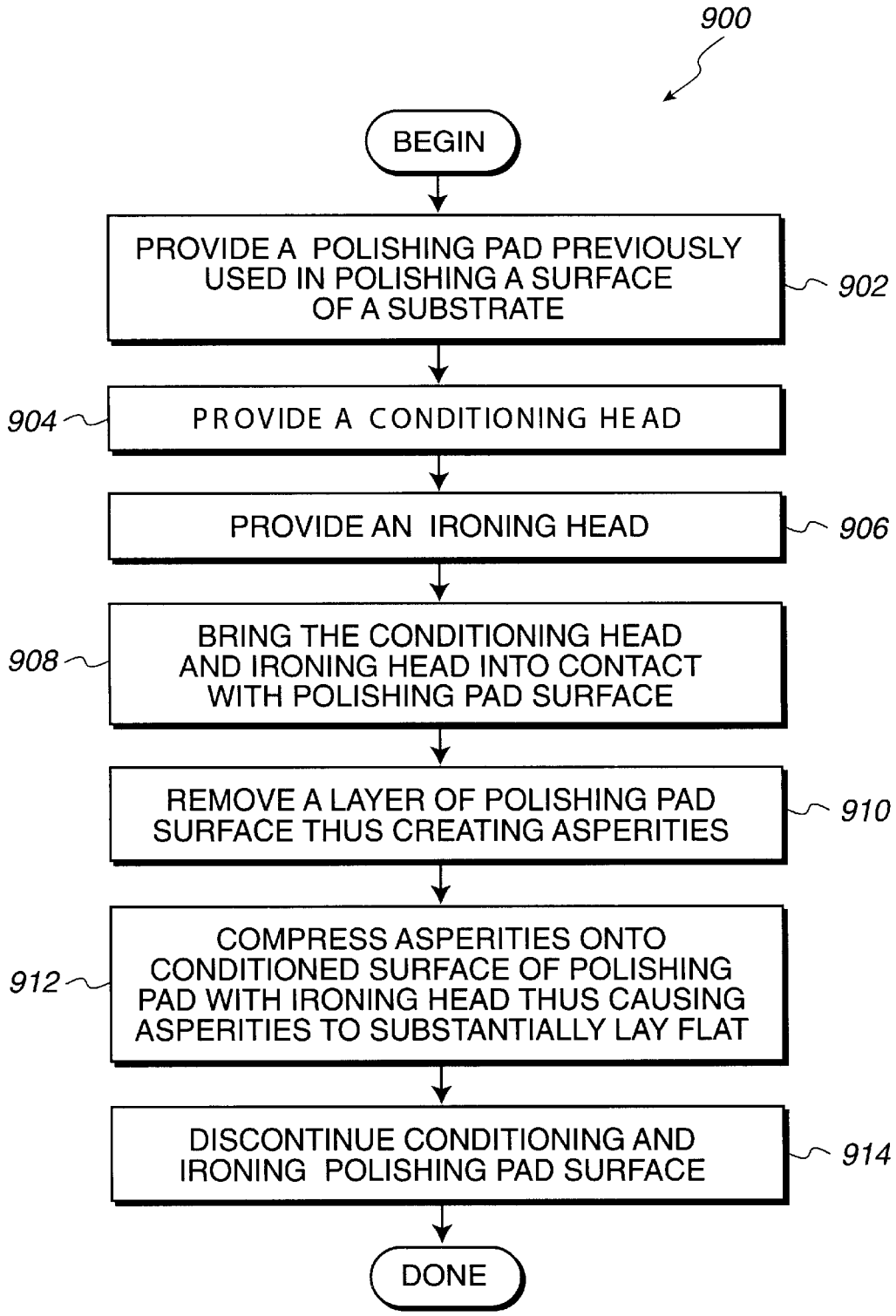
FIG. 9 is a flow chart of a method for correlated conditioning and ironing of a post-conditioned polishing pad, in accordance with another aspect of the present invention.

FIG. 9 is flowchart showing a method 900 for concurrent conditioning and ironing of a post-conditioned polishing pad, in accordance to one embodiment of the present invention. The method begins at operation 902 in which a polishing pad previously used in the polishing of the surface layers of a substrate is provided. Thereafter, in operations 902 and 904, a conditioning head and an ironing head are respectively provided. The method then continues to operation 908 in which the conditioning head and the ironing head are brought into contact with the surface of the polishing pad. In a subsequent operation 910, the surface of the polishing pad is conditioned so as to remove the worn layer, thus creating asperities on the polishing pad surface. Thereafter, in operation 912, the ironing head is used to compress the asperities onto the conditioned surface of the polishing pad causing the asperities to lay substantially flat. The method then continues to operation 914 in which the conditioning and ironing of the polishing pad surface are discontinued.

It is important to note that by flattening the asperities instants after their formation, especially the asperities that significantly protrude above the surface of the post-conditioned polishing pad, the planarization uniformity of the CMP system of the present invention is believed to be maximized. In particular, this is achieved by drastically reducing the damaging effects of dishing, corner rounding and dielectric erosion caused by the application of the asperities onto the wafer surface.

Figure 10:
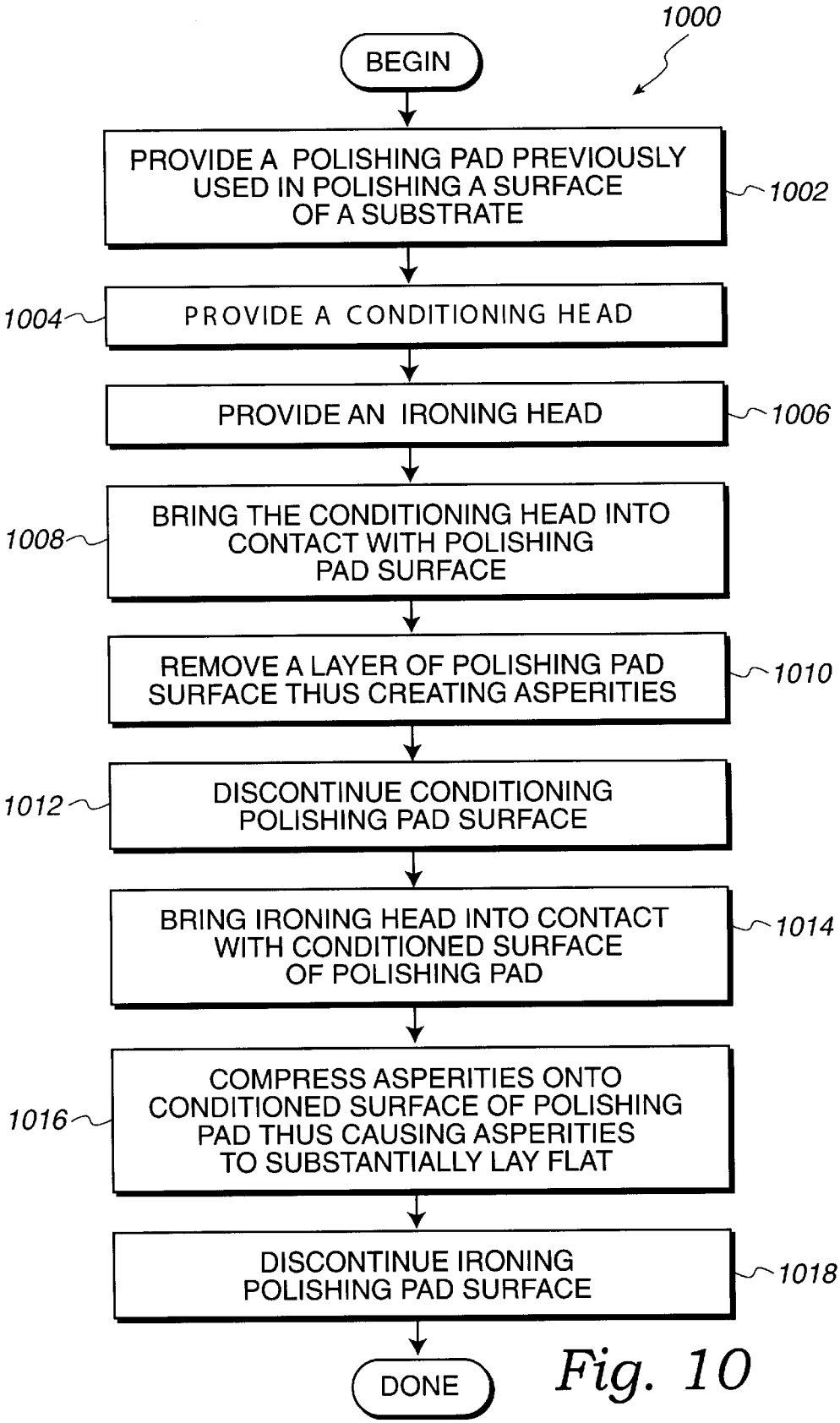
FIG. 10 is a flow chart depicting a method for ironing a post-conditioned polishing pad, in accordance with yet another embodiment of the present invention.

Reference is now made to FIG. 10 depicting a flowchart of a method 1000 for ironing a post-conditioned polishing pad, in accordance with another embodiment of the present invention. The method beings by operation 1002 in which a polishing pad previously used in the polishing of a surface of a substrate is provided. Next, in subsequent operations 1004 and 1006, a conditioning head and an ironing head are respectively provided. Thereafter, in operation 1008, the conditioning head and the polishing pad surface are brought into contact followed by operation 1010 in which a layer of the polishing pad surface is removed, thus creating asperities. Then, in operation 1012, the conditioning operation is discontinued. Continuing to operation 1014, the ironing head and the conditioned surface of the polishing pad are brought into contact. As a result, in operation 1016, the asperities are compressed onto the conditioned surface of the polishing pad causing the asperities to substantially lay flat. Finally, in operation 1018, the ironing of the polishing pad surface is discontinued.

Again, it must be noted that the ironing of the asperities formed on the surface of the post-conditioned polishing pad significantly reduces the negative effects of dishing, corner rounding, and dielectric erosion, thus maximizing the planarization uniformity of the CMP system.

Although the foregoing invention has been described in some detail for purposes of clarity of understanding, it will be apparent that certain changes and modifications may be practiced within the scope of the appended claims. For example, embodiments described herein have been primarily directed toward wafer CMP; however, it should be understood that the planarization, conditioning, and ironing operations of the present invention are well suited any type of substrate. Furthermore, implementations described herein have been particularly directed toward chemical mechanical planarization of wafers having heterogeneous surfaces defined after the removal of an over-burden layer; however, it should be understood that the chemical mechanical planarization operations of the present invention are well suited for maximizing planarization uniformity in planarizing any type of material. Accordingly, the present embodiments are to be considered as illustrative and not restrictive, and the invention is not to be limited to the details given herein, but may be modified within the scope and equivalents of the appended claims.

What is claimed is:

1. A method for smoothing a surface of a polishing pad previously used in planarizing a surface of a substrate in a chemical mechanical planarization (CMP) system, the method comprising:

conditioning the surface of the polishing pad, the conditioning being configured to create a post-conditioned surface having an asperity; and ironing the post-conditioned surface of the polishing pad, the ironing being configured to compress the asperity onto the post-conditioned surface of the polishing pad, thereby causing the asperity to lay substantially flat against the post-conditioned surface of the polishing pad.

2. A method for smoothing a surface of a polishing pad previously used in planarizing a surface of a substrate in a CMP system as recited in claim 1, wherein the conditioning includes:

applying a conditioning surface onto the surface of the polishing pad.

3. A method for smoothing a surface of a polishing pad previously used in planarizing a surface of a substrate in a CMP system as recited in claim 2, wherein the conditioning is designed to remove a worn layer of the surface of the polishing pad, the removing being designed to open a plurality of air pockets disbursed in the polishing pad so as to create pores and the asperity.

4. A method for smoothing a surface of a polishing pad previously used in planarizing a surface of a substrate in a CMP system as recited in claim 1, wherein the ironing of the post-conditioned surface of the polishing pad includes:

applying an ironing surface onto the post-conditioned surface of the polishing pad.

5. A method for smoothing a surface of a polishing pad previously used in planarizing a surface of a substrate in a CMP operation as recited in claim 1, wherein the ironing surface is made out of carbon dioxide.

6. A method for smoothing a surface of a polishing pad previously used in planarizing a surface of a substrate in a chemical mechanical planarization (CMP) system, the method comprising:

conditioning the surface of the polishing pad, the conditioning being configured to create a post-conditioned surface having a plurality of asperities; and ironing the post-conditioned surface of the polishing pad, the ironing being configured to compress the plurality of asperities onto the post-conditioned surface of the polishing pad, thereby causing the plurality of asperities to lay substantially flat against the post-conditioned surface of the polishing pad.

7. A method for smoothing a surface of a polishing pad previously used in planarizing a surface of a substrate in a CMP system as recited in claim 6, wherein the conditioning includes:

applying a conditioning surface onto the surface of the polishing pad.

8. A method for smoothing a surface of a polishing pad previously used in planarizing a surface of a substrate in a CMP system as recited in claim 7, wherein the conditioning is designed to remove a worn layer of the surface of the polishing pad, the removing being designed to open a plurality of air pockets disbursed in the polishing pad so as to create pores and the plurality of asperities.

9. A method for smoothing a surface of a polishing pad previously used in planarizing a surface of a substrate in a CMP system as recited in claim 6, wherein the ironing of the post-conditioned surface of the polishing pad includes:

applying an ironing surface onto the post-conditioned surface of the polishing pad.

10. A method for smoothing a surface of a polishing pad previously used in planarizing a surface of a substrate in a chemical mechanical planarization (CMP) system, the method comprising:

conditioning the surface of the polishing pad by applying a conditioning surface onto the surface of the polishing pad, the conditioning being configured to create a post-conditioned surface having an asperity; and ironing the post-conditioned surface of the polishing pad, the ironing being configured to compress the asperity onto the post-conditioned surface of the polishing pad, thereby causing the asperity to lay substantially flat against the post-conditioned surface of the polishing pad.

* * * * *

UNITED STATES PATENT AND TRADEMARK OFFICE

CERTIFICATE OF CORRECTION

PATENT NO. : 6,579,157 B1
APPLICATION NO. : 09/823788
DATED : June 17, 2003
INVENTOR(S) : Gotkis et al.

It is certified that error appears in the above-identified patent and that said Letters Patent is hereby corrected as shown below:

Column 14, claim 5, line 60, replace "surface is made out of carbon dioxide." with --surface is made out of silicon carbide.--

Signed and Sealed this

Sixth Day of February, 2007

JON W. DUDAS
*Director of the United States Patent and Trademark Office*